US005390538A

United States Patent [19]

Spath

[11] Patent Number: 5,390,538

[45] Date of Patent: Feb. 21, 1995

[54] PROCESS FOR BENDING METAL HOLLOW SECTIONS AND APPARATUS FOR CARRYING OUT THE PROCESS

[76] Inventor: Walter E. Spath, Hardstrasse 8, D-7705, Steisslingen, Germany

[21] Appl. No.: 101,771

[22] Filed: Jul. 30, 1993

Related U.S. Application Data

[63] Continuation of Ser. No. 810,964, Dec. 20, 1991, abandoned.

[30] Foreign Application Priority Data

Dec. 22, 1990 [DE] Germany ..... 4041668

[51] Int. Cl.[6] ..... B21D 7/04

[52] U.S. Cl. ..... 72/133; 72/150; 72/172; 72/370

[58] Field of Search ..... 72/133, 134, 150, 166, 72/169, 170, 172, 208, 370

[56] References Cited

U.S. PATENT DOCUMENTS

| | | | |
|---|---|---|---|
| 3,205,690 | 9/1965 | Roessler, Jr. | 72/150 |
| 3,388,573 | 6/1968 | Presley, Jr. | 72/172 |
| 3,949,582 | 4/1976 | Eaton et al. | 72/150 |
| 4,031,733 | 6/1977 | Coody | 72/166 |
| 4,331,015 | 5/1982 | Benteler et al. | 72/133 |
| 4,331,016 | 5/1982 | Benteler et al. | 72/133 |
| 4,481,803 | 11/1984 | Dieser | 72/150 |
| 4,959,984 | 10/1990 | Trudell et al. | 72/150 |

FOREIGN PATENT DOCUMENTS

| | | | |
|---|---|---|---|
| 3641895 | of 1976 | Germany . | |
| 2518798 | of 1987 | Germany . | |
| 1189534 | 11/1985 | U.S.S.R. | 72/150 |
| 1274803 | 12/1986 | U.S.S.R. | 72/150 |

OTHER PUBLICATIONS

"Neues aus Technik und Industrie," Industrie-Rundschau, Sep. 1955, S. 20/21/19.

*Primary Examiner*—Lowell A. Larson
*Assistant Examiner*—Thomas C. Schoeffler
*Attorney, Agent, or Firm*—Lackenbach, Siegel, Marzullo, Aronson & Greenspan

[57] ABSTRACT

A roller-mandrel thrust bending process (RDSB process) is described, serving to bend metal hollow sections. Starting from the known rolling-bending process, where the hollow section to be bent is filled in its interior and is run into a bending station consisting of several bending rollers, the bending of the hollow section is produced by the movement of the bending rollers in the bending plane. To preserve the advantages of core stretching and bending while avoiding the high costs of this process, it is provided according to the invention that the hollow section of the workpiece is filled by a base mandrel and that the workpiece is pushed into the bending station under thrust. Thus the workpiece to be bent is displaced under thrust and under the friction force of the profile rollers over the mandrel stationary in the bending zone and bent in XYZ direction by the bending station.

10 Claims, 2 Drawing Sheets

PROCESS FOR BENDING METAL HOLLOW SECTIONS AND APPARATUS FOR CARRYING OUT THE PROCESS

This application is a continuation of application Ser. No. 07/810,964, filed Dec. 20, 1991, now abandoned.

BACKGROUND OF THE INVENTION

1. Field of the Invention

The subject matter of the invention is a process for the bending of metal hollow sections and an apparatus for carrying out the process.

2. Description of the Prior Art

Thus far there is known a so-called core stretching-bending process, which includes by the following characteristics:

A rotatably driven bending pattern is disposed on a tool holder. The section is clamped and bent around this core while applying a traction on the section to be bent.

With such a core stretching-bending process, in which, when using hollow sections, mandrels are taken along in the cavity of the section, it is possible to shape complicated sections with narrow radii.

It is not necessary to fill and to stabilize the hollow section by sand or other support materials.

The core stretching-bending process is used above all when large quantities of workpieces to be bent are demanded, where a bending process in the same direction always takes place successively on the same bending pattern.

Core stretch-bending according to the known prior art is also used whenever the rolling-bending process, also known per se, can no longer be used with narrow radii.

The rolling-bending process involves shaping of a workpiece between bending rollers designed as profile rollers. There may be three or four profile rollers, two lower bending rollers being, as a rule, spaced from each other, and if desired they may be arranged tiltable or pivotable at a housing, and opposite the two lower bending rollers there is a fixed upper bending roller which engages in the space between the two lower bending rollers. The section to be shaped is introduced into the interstice between the upper bending roller and the two lower, mutually spaced bending rollers, it being guided through by a rotational drive of the bending rollers. The shaping then occurs around the upper central roller (bending roller).

In another form of the realization it is known practice to arrange the two lower bending rollers fixed at a machine tool and to design the upper, central bending roller for feed or advance into the interstice between the two lower bending rollers in the direction of the workpiece.

Instead of the three-roller bending machine here described, also the use of a fourth, central bending roller is known, the fourth central bending roller being arranged below the upper central bending roller.

This results in the advantage that the section opposite the upper central bending roller cannot give way downwardly because it is guided and supported by the lower central bending roller.

What is determining here is not the downwardly pointing guidance of the section, but also the lateral guidance, which is achieved by the lower central bending roller.

This rolling-bending process with three or four bending rollers is used whenever relatively large bending radii must be bent depending on section size or respectively small quantities, which also may have different radii.

For the bending of hollow sections with such three- or four-roller bending machines the hollow cross-section must, as a rule, be filled in order to support and stabilize it. This measure of filling the hollow section for the purpose of support during the bending operation takes time and is relatively cost-intensive. Furthermore, filling of the hollow cross-section with a filling material increases the bending resistance and hence also the specific surface pressure on the section now necessary to bend the reinforced section. Thereby flexing phenomena and roll-outs on the hollow section are created, which in turn are undesirable and adversely affect the quality of the bending process.

SUMMARY OF THE INVENTION

It is the object of the present invention to develop a process which uses a three- or four-roller bending machine in such a way that narrow radii of a hollow section can be produced cost efficiently without using the relatively expensive core stretching-bending process for tools.

For the solution of the problem posed, it is important, therefore, that the section to be bent is bent in a three-, four- or multi-bending roller station, known per se, that the section is filled with a mandrel, and that the bending zone of the hollow section stiffened by the mandrel and the resulting increased bending resistance are compensated by the section to be bent receiving a thrust on the feed side to the bending roller station.

The technical teaching according to the present invention therefore resides in that now the hollow section to be bent no longer needs to be filled with a material, but that a relatively inexpensive mandrel is used, which is either a solid mandrel or a jointed mandrel.

It was realized that such a mandrel greatly complicates the shaping operation and—without countermeasures—impairs the quality of the shaping.

To compensate for these negative phenomena, it is provided according to the invention that the section is inserted between the rollers of the bending roller station from the feed side of the section with a thrust. In this manner the bending process is greatly facilitated and the quality is improved.

The mandrel remains at the bending point, while the section is passed over the stationary mandrel with a thrust. Upsetting forces now occur at the bending point between the stationary mandrel, the hollow section pushed beyond the mandrel, and the associated bending rolls. Hence it is the thrust on the hollow section that now makes such shaping possible. For in the absence of such a thrust, the frictional engagement between the rotationally driven bending rollers and the outer circumference of the hollow section would no longer suffice to guide the hollow section through the shaping zone at constant speed due to the high induced resistance by the mandrel filling the hollow section.

Now if according to the invention a thrust is exerted on the hollow section, there is no longer any need for a high friction engagement and a corresponding torque between the bending rollers and the outer circumference of the hollow section, because the hollow section is pushed through the bending rollers.

What is important is that a combination of the friction forces of the bending rollers and the thrust forces on the hollow section is applied to optimize the shaping performance of the bending rollers.

On the other hand, it is possible not to drive the rollers in rotation, but to let them idle and to carry out the shaping process by the thrust applied on the workpiece from the feed side.

In a further embodiment of the present invention it is provided to use, instead of the previously described bending rollers, stationary sliding blocks which by corresponding friction-facilitating linings abut on the outer circumference of the hollow section. In this form of realization also it is typical that the hollow section is filled with a solid or jointed mandrel at least in the bending zone and that the hollow section is then pushed through the sliding block arrangement with the required thrust necessary for the bending process.

In all forms of realization described it is important that the thrust applied on the workpiece on the feed side does not lead to a bulging of the hollow section on the feed side. For this purpose it is provided that on the feed side before the bending roller station or sliding block station the section is guided with a profile roller guiding station. This profile roller guiding station, therefore, serves to avoid buckling of the section just then supplied to the bending roller or sliding block station.

Instead of one profile roller guiding station, several stations may be used.

The thrust to be applied on the hollow section is generated by a section pushing slide consisting of a roller vehicle or sliding vehicle driven to move in a rail bed of U-shaped or similar profile. This section pushing slide has a push arm in the form of a cross arm which exerts a thrust on a cover applied on the end face of the workpiece, so that this rod-like workpiece is pushed through the bending station, the rotationally driven bending rollers of the bending station supporting the thrust.

In another embodiment of the present invention it is provided, instead of an end-face cover and thrust arm of the section pushing slide bearing thereon, to use a clamping chuck which is connected with a slide driven in axial direction of the workpiece. The clamping chuck then embraces the hollow section at its outer circumference, and the slide driven in axial direction of the workpiece then pushes this clamped workpiece into the profile roller station.

In a preferred embodiment of the present invention also the bending roller station is developed in a special way. Protection also for these additional features is claimed under the present invention.

The bending roller station according to the present invention consists, not of a conventionally known three- or four-bending roller arrangement, but of a bending arrangement with at least six rollers.

It is essential that the section to be bent is guided firstly between at least four bending rollers (two bending roller pairs) exactly straight, to prevent it from giving way upward or downward.

At the outlet of this four-roller bending arrangement, a cross slide displaceable in at least two mutually perpendicular directions is arranged which carries an additional bending roller pair.

The section to be bent is thus bent on the cross slide in the interstice between the four-roller arrangement and the bending rollers. The essential advantage of this is that the section to be bent can be bent in both directions (in the drawing to be explained later, FIG. 1: vertically upward or downward) and respectively to the left or right.

All six bending rollers are rotationally driven and in this connection it is essential that still other bending rollers can be present; in the embodiment to be explained later smaller rollers are also present which clamp and guide the section in the interstice between the larger bending rollers, or instead of the four larger bending rollers one or several of the larger bending rollers may be replaced by smaller bending rollers.

With the described bending equipment, therefore, the essential advantage exists that one can bend relative to a horizontal plane (XY) to the left and right continuously in any desired radii, the radii depending on the displacement of the cross slide and the bending rollers arranged thereon and on the thrust exerted.

The advantages of the invention result in particular when bending large-volume sections. Such large-volume sections were until now bent by the core stretching-bending process, which involved the disadvantage that there was only a stationary bending pattern and only a relatively small radius could be bent with this stationary bending pattern. Larger bending patterns could not be produced for economic reasons because then for example bending patterns with a radius of 20 m and more would be required, which can no longer be produced at an acceptable cost.

For the bending of this section it was moreover necessary to fill the cavity with a material, which precisely for large-volume sections is especially cost-intensive.

This is where the advantages of the present invention come in, because a bending pattern of fixed radius is avoided and instead of it any desired bending radii can be bent with high precision, with the advantages of core stretch-bending, namely that over a mandrel a precise cross-section stabilization of the section form during shaping takes place and at the same time the high variability of the radius control is achieved as could be obtained only with the conventional three- or four-roller bending process.

It is thus possible to bend also long sections according to the present invention with lengths of for example 20–30 m with bending radii starting with small radii of for example 1 m up to an infinite bending radius. Thereby the advantages of core stretch-bending (high precision, narrow radii) are combined with the advantages of rolling-bending shaping, namely to bend any desired radii independently of a bending pattern on any desired length.

In a further development of the present invention it is provided that not only a bending of the section in one plane takes place (XY plane), but that in addition a torsion is created due to the fact that the cross slide is arranged pivotable in the direction of the longitudinal axis of the workpiece, in order additionally to twist the section to be bent if that is necessary.

In a further development of the present invention it is additionally provided that the cross slide movable in XY direction is movable as well in Z direction, so that a three-dimensional bending of the section in XY—Z plane is possible.

As a further plane there is then added the torsion bending, which can extend in all three space axes.

The cross slide must then sit on an additional slide movable in the Z direction. The entire displacement in the XY and Z planes may be CNC controlled or SPS controlled or may be realized in joint action of both control systems.

The subject matter of the present invention results not only from the subject of the individual claims, but also from the combination of the individual claims with one another. All data and characteristics disclosed in the documents—including the abstract—in particular the spatial layout illustrated in the drawings are claimed as essential to the invention, insofar as they are new individually or in combination relative to the prior art.

BRIEF DESCRIPTION OF THE DRAWINGS

In the following the invention will be explained more specifically with reference to drawings representing merely one form of realization. From the drawings and their description further features essential to the invention and advantages of the invention will become evident.

DESCRIPTION OF THE PREFERRED EMBODIMENT

Figure 1:
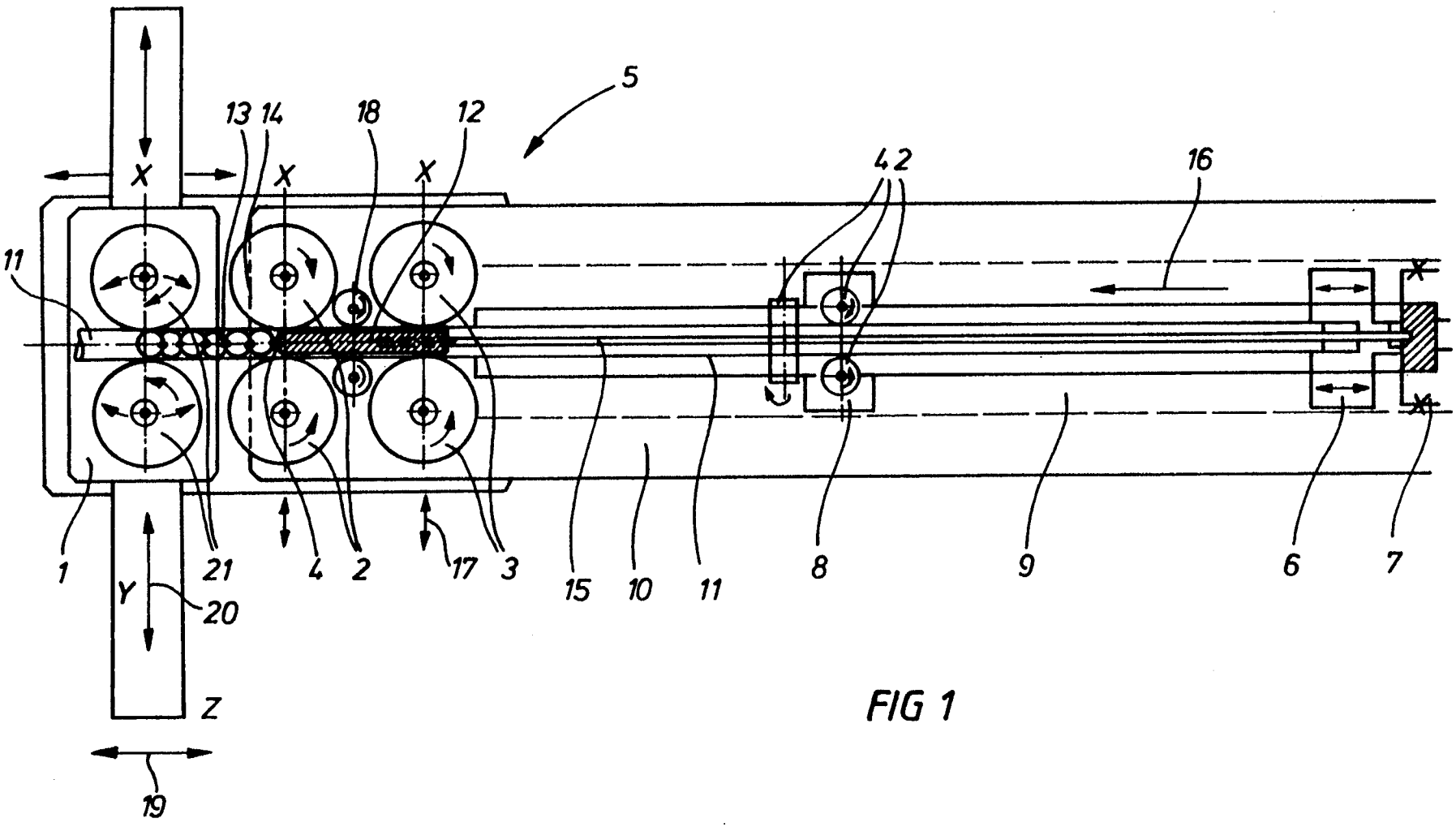
FIG. 1 is a schematic top plan view of an apparatus for execution of the Rolling Mandrel Thrust Bending (RDSB) process.

The apparatus for execution of the RDSB process (Rolling Mandrel Thrust Bending process) consists essentially of a platen 10, on which the rod-shaped workpiece to be bent is arranged displaceable in the direction of its longitudinal axis. In the interior of the workpiece 11 formed a hollow section a base mandrel 4 is arranged, designed as in two parts in the embodiment example as shown and consisting of a rear solid mandrel body 12 and a front jointed mandrel 13 that can be bent aside in an articulated manner. The two parts are joined together.

At the rear end of the mandrel body 12 is a mandrel holding rod 15 (cf. FIG. 4), which is received in a mandrel holding station 7.

Engaging at the workpiece 11 is a further section pushing slide 6 (cf. FIGS. 2 and 3), which pushes the workpiece 11 in the direction of the arrow 16 into the bending station 5.

The bending station has eight bending rollers in all, the interaction of which will be described below.

There are two bending roller pairs 2, 3 which are rotatably arranged at platen 10 and are driven in the arrow directions indicated.

The lower bending rollers of the bending roller pair 2,3 may be mounted each on its own slide displaceable in arrow directions 17 on platen 10, so as to make the gap between the bending rollers 2 and 3 adjustable, to adapt this gap to the workpiece width.

In the interstice between the two larger bending roller pairs 2,3 an additional smaller bending roller pair 18 may be arranged as well.

Behind the bending roller pairs 2,3 as seen in transport direction of the workpiece, a further bending roller pair 21 is arranged, which is arranged on a cross slide 1. It may be provided here that the lower roller of the bending roller pair 21 is also adjustable in arrow direction 17 toward the upper roller, as had been illustrated in reference to the bending roller arrangement 2,3.

The cross slide 1 is displaceable in two mutually perpendicular arrow directions 19,20 (X—Y direction), so that the workpiece received between the bending roller pair 21 is freely bendable in the X—Y plane.

In addition it is provided that the cross slide 1 is arranged rotatable about the longitudinal axis of workpiece 11, in order to give the workpiece a torsion (if desired) in addition to the bending in X—Y direction.

In a third embodiment, not specifically shown in the drawing, it may be provided that the cross slide 1 is part of a further slide, so that the cross slide 1 is movable also perpendicular to the drawing plane of FIG. 1 (in Z direction), so that the workpiece 11 can be bent three-dimensionally and twisted in addition.

What is important is that the mandrel body 12 of base mandrel 4 is arranged in the bending zone 14, with possibly a jointed mandrel 13 following the mandrel body 12.

Bending, therefore, can occur in all planes, as e.g. in the XY plane, the XZ plane, the YZ plane, or the XYZ plane. As was explained initially, the bending of workpiece 11 with a base mandrel 4 disposed therein is made extremely difficult by the base mandrel 4 engaging in the hollow section. To eliminate such bending resistances, it is now provided that the section of workpiece 11 is pushed in the direction of the arrow 16 into the bending station 5 by a section pushing slide 6. The organization of the section slide 6 will be explained later with reference to FIGS. 2 and 3.

So that the workpiece 11 will not buckle sideways in the area of the thrust on platen 10, a profile roller guide station 8 is provided, which receives the section between its rollers and guides it positively.

The profile roller guide station is arranged displaceable along the workpiece and fixable at platen 10 and comprises guide rollers 42 which abut positively at the outer circumference of workpiece 11.

Instead of a single profile roller guide station 8, several may be arranged successively spaced from each other.

For displacement control of the profile roller guide station and of the section pushing slide 6, a track 9 is arranged on the platen 10, within which said parts 6,7,8 are guided displaceable and fixable.

Base mandrel 4 is held by a mandrel holding rod 15 which is secured in a mandrel holding station 7.

Figure 2:
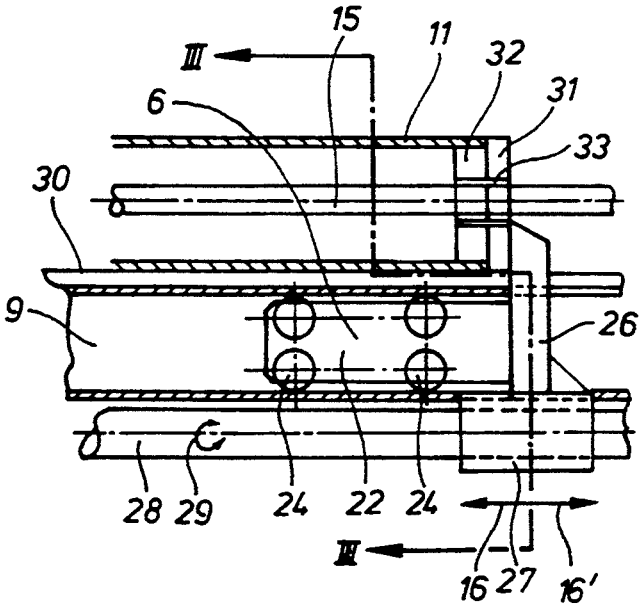
FIG. 2, is a section through a section-pushing slide.

FIG. 2 shows a sectional view of a section pushing slide 6.

It can be seen that a guide carriage 22 is slidably guided over four rollers 24 in the interior of a hollow section 25. Carriage 22 is connected through a cross arm 26 to a spindle nut 27 which embraces a drive spindle 28.

Drive spindle 28 is driven for rotation in the arrow directions 29 shown.

Cross arm 26 engages through an upper, horizontally extending slit 30 in hollow section 25 and is firmly connected to a plate 31.

Plate 31 has an inner shoulder 32 which engages in the hollow section of workpiece 11.

Plate 31 and shoulder 32 are adapted to the inner profile of workpiece 11, so that shoulder 32 abuts positively against the inner circumference of workpiece 11 and plate 31 abuts against the rear end face of workpiece 11.

The two parts 31, 32 have a bore 33 through which the mandrel holding rod 15 engages with sufficient radial clearance. Now if the drive spindle 28 is driven in one of the arrow directions 29, the spindle nut 27 moves along on the drive spindle, so that the entire guide carriage 22 is moved along platen 10 in arrow direction 16. Thereby the rear end face of workpiece 11 is pushed via cross arm 26 and the parts 31, 32 along the platen into the bending station 5 in arrow direction 16. The mandrel holding rod 15 remains fixed relative to platen 10.

Thereby the necessary thrust in arrow direction 16 onto workpiece 11 in the direction of the bending zone 14 is created. Since the mandrel holding rod 15 with the base mandrel 4 remains stationary, workpiece 11 is thereby pushed in arrow direction 16 over the stationary mandrel and is at the same time bent by the bending station 5 in conjunction with the movable bending station (cross slide 1).

Figure 3:
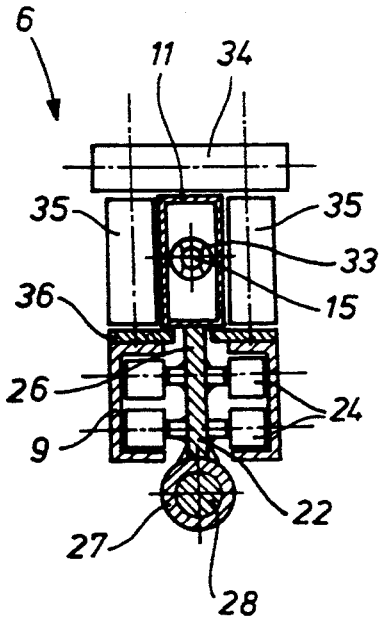
FIG. 3, is a section along line III—III in FIG. 2 through the section-pushing slide with workpiece.

FIGS. 2 and 3 also show, by the way, that on the underside of the workpiece a friction lining 36 may engage which abuts frictionally on the workpiece 11 and is connected to the guide carriage 22.

FIG. 3 shows further (supplementing FIG. 2) that on the outer circumference of workpiece 11 guide rollers 34, 35 may abut which are connected to carriage 22.

It is pointed out, by the way, that the profile roller guide station 8 is organized exactly as has been explained with reference to carriage 22 in FIG. 3, except that in the profile roller guide station the part 31,32 exerting the thrust on the workpiece in conjunction with cross arm 26 is missing.

Otherwise the profile roller guide station 8 uses a similar arrangement as explained in FIGS. 2 and 3, with the especially important point that with this profile roller guide station the guide rollers or sliding blocks 34,35 shown in FIG. 3 are provided to prevent the section of workpiece 11 under thrust from buckling.

Accordingly, sliding blocks may be used instead of the guide rollers shown in FIG. 3.

In another form of realization not shown in the drawing it is provided that instead of the thrust illustrated in FIG. 2 onto the rear end face of workpiece 11 a clamping tool can be used via parts 31,32 which abuts in positive engagement on the outer circumference of the workpiece and may even engage into the inner circumference of the workpiece in order to clamp the workpiece without deformation and to drive it for displacement in arrow direction 16.

Figure 4:
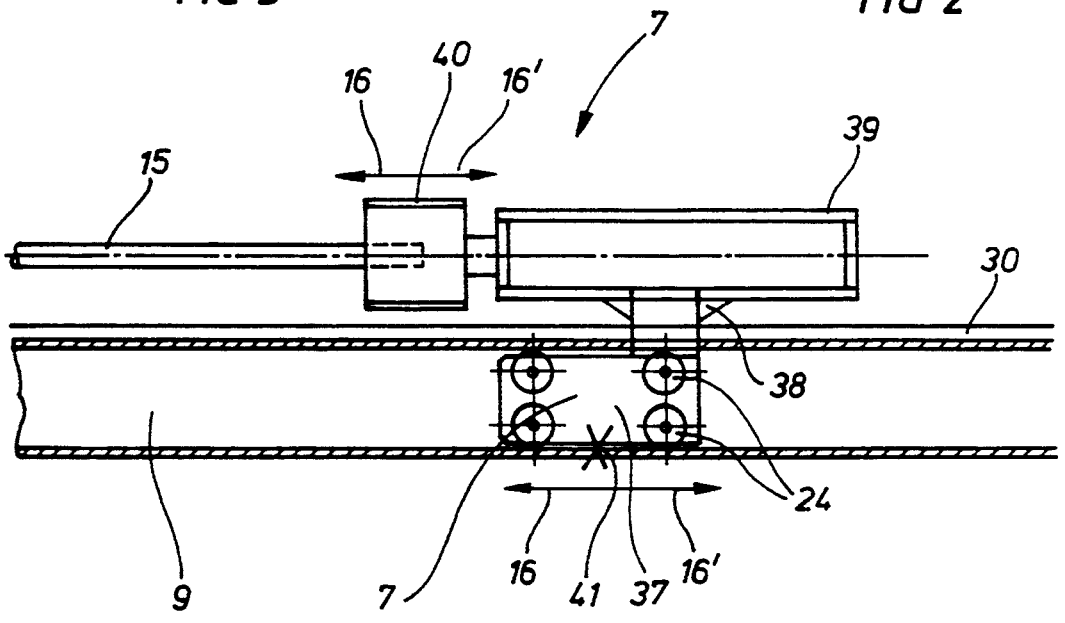
FIG. 4, is a side view of a mandrel holding station partially in section.

FIG. 4 shows schematically the section through a mandrel holding station. An important point is that the mandrel holding station too is designed displaceable in arrow direction 16 and in the opposite direction.

In accordance with the bending function, in fact, the base mandrel 4 must always be kept in the bending zone 14. However, the bending zone 14 is not a constant point between the front roller pair 2 of bending station 5, but can vary in axial direction along workpiece 11. To take these variations into account, the base mandrel 4 must be readjusted in arrow direction 16 or respectively 16'. Also in the region of the hollow section of track 9 a guide carriage 37 is arranged, which takes support by associated rollers 24 on the inner circumference of the hollow section of track 9. The guide carriage is connected to a cross arm 38 which engages through a slit 30 in the top side of track 9 and is connected there to a clamping head 39. The clamping head has a front chuck 40 receiving the mandrel holding rod 15 at the rear end face.

The stop 41 between guide carriage 37 and associated track 9 is only schematized. In the normal case, therefore, the base mandrel 4 is pushed into workpiece 11 and advanced up into the bending zone 14. Stop 41 is then activated, so that guide carriage 37 remains firmly anchored in the hollow section of track 9.

Any now required readjustment of the mandrel to the changing bending zone 14 is brought about by the rotary chuck 40 which is rotatably arranged in the clamping head 39 and is additionally displaceable in axial direction of the workpiece (in arrow directions 16,16') and fixable. Actuation of chuck 40 in the arrow directions 16,16' or respectively in rotation about the mandrel holding rod can be effected hydraulically, mechanically, or electromechanically.

Instead of the carriages 22, 37 here described, a guiding rail system with slide can be employed, which too is precise as to guidance. The only important thing is that by the section pushing slide 6 a thrust is exerted on the workpiece in arrow direction 16 and that further the profile roller station 8 is arranged displaceable and fixable in track 9 and besides the mandrel holding station 7 is also arranged displaceable and fixable in track 9 and besides the mandrel holding rod 15 is adjustable in arrow directions 16,17' when the mandrel holding station 7 is stopped.

The special advantage of the process according to the invention resides in that fillings of the hollow section of workpiece 11 are no longer necessary because the required section stabilization is provided by the base mandrel 4. Filling of the section with sand or with other materials can be dispensed with. Thus radii can be bent in workpiece 11 in a continuous manner, it being possible to bend different radii successively. Due to the CNC control of the entire machine, bending processs can thus be accomplished automatically with great repeating accuracy.

It is thus possible for the first time to achieve, beyond the normal rolling bending (with a three- or four-roller bending machine), a reciprocal bending in the form of a sine curve. The bending direction, therefore, can be varied continuously in positive or negative direction, representing a serpentine form to the left or right in the XY plane.

If the cross slide 1 is movable also in the Z direction, bending in the third bending plane is possible as well and in addition a torsion can be superimposed on all bending movements.

I claim:

1. A method of bending hollow metal sections by rolling, comprising the steps of advancing an elongate hollow metal section having a longitudinal axis to a bending station including bending rollers; inserting a mandrel into the hollow metal section to extend to the region of the bending station; independently advancing the metal section and the mandrel to the bending station; selectively applying a rotary motion to the mandrel; applying a rotary motion to the metal section while being advanced; and selectively displacing the bending rollers at the bending station along at least one of three mutually orthogonal directions and selectively rotating the bending rollers about the axis of the metal section, whereby bending of the metal section can be accurately controlled without undesired deformation or damage to the metal section.

2. A method as defined in claim 1, wherein said step of advancing the metal section includes applying a thrusting force to the metal section in the direction of the longitudinal axis.

3. Apparatus for bending hollow metal sections by rolling, comprising a bending station; guide means for guiding a hollow metal section along an axis of the apparatus to said bending station; a mandrel; mandrel holding means for securing said mandrel; means for advancing said mandrel into the hollow portion of the metal section and extending to said bending station; means for applying a thrusting force to the metal section in the direction of the bending station; means for applying a rotary motion to said mandrel holding means and the metal section; and means for selectively rotating said bending station about said axis and linearly displacing said bending station relative to said axis; whereby bending of the metal section can be accurately controlled without undesired deformation or damage to the metal section.

4. Apparatus as defined in claim 3, wherein said guide means comprises a track supporting the metal section, said means for applying a thrusting force comprising a pushing device arranged to exert a longitudinal pushing force along said track on the metal section.

5. Apparatus as defined in claim 4, wherein said pushing device comprises a section-pushing slide driven for displacement along said track and including means for connection to the metal section.

6. Apparatus as defined in claim 5, further comprising at least one hollow metal section roller guiding station displaceable and fixable along said track which at least partially and positively embraces the metal section at an outer circumference of the metal station.

7. Apparatus as defined in claim 3, wherein said bending station consists of a number of bending roller pairs forming a fixed passage gap and further consists of at least one bending roller pair displaceable and rotatable in a bending plane.

8. Apparatus as defined in claim 3, wherein said mandrel consists of a bendable mandrel body filling the hollow section of the metal section.

9. Apparatus as defined in claim 3, wherein said mandrel comprises a jointed mandrel.

10. Apparatus as defined in claim 3, wherein said mandrel holding means is rotatably received in a rotary chuck.

* * * * *